US007905742B2

(12) United States Patent
Wollitzer et al.

(10) Patent No.: US 7,905,742 B2
(45) Date of Patent: Mar. 15, 2011

(54) COAXIAL PLUG FOR CONNECTING TO A BNC COAXIAL SOCKET

(75) Inventors: Michael Wollitzer, Fridolfing (DE); Manuela Fuhrich, Tittmoning (DE); Frank Tatzel, Ostermiething (AT); Herbert Babinger, Kirchanschoring (DE); Hans-Dieter Konig, Haar (DE); Martin Peschke, Munich (DE); Stefan Ullrich, Tutzing (DE); Thomas Reichel, Baldham (DE); Ralf Hagenbusch, Munich (DE)

(73) Assignees: Rosenberger Hochfrequenztechnik GmbH & Co. KG, Fridolfing (DE); Rohde & Schwarz GmbH & Co. KG, Munich (DE)

( * ) Notice: Subject to any disclaimer, the term of this patent is extended or adjusted under 35 U.S.C. 154(b) by 0 days.

(21) Appl. No.: 12/520,367

(22) PCT Filed: Dec. 6, 2007

(86) PCT No.: PCT/EP2007/010623

§ 371 (c)(1), (2), (4) Date: Dec. 9, 2009

(87) PCT Pub. No.: WO2008/080501

PCT Pub. Date: Jul. 10, 2008

(65) Prior Publication Data

US 2010/0105234 A1 Apr. 29, 2010

(30) Foreign Application Priority Data

Dec. 20, 2006 (DE) ..... 20 2006 019 203 U

(51) Int. Cl.
*H01R 13/625* (2006.01)

(52) U.S. Cl. ..... 439/341; 439/157

(58) Field of Classification Search ..... 439/152–160, 439/341, 352, 372

See application file for complete search history.

(56) References Cited

U.S. PATENT DOCUMENTS

| | | | | |
|---|---|---|---|---|
| 5,344,194 | A * | 9/1994 | Hatagishi et al. | 285/26 |
| 5,509,816 | A * | 4/1996 | Katsuma | 439/157 |
| 5,611,703 | A * | 3/1997 | Okamoto et al. | 439/157 |
| 5,823,808 | A | 10/1998 | Clark | |
| 6,315,585 | B1 * | 11/2001 | Oka | 439/157 |
| 6,517,364 | B2 * | 2/2003 | Muramatsu et al. | 439/157 |
| 2005/0037652 | A1 | 2/2005 | Zahlit et al. | |

FOREIGN PATENT DOCUMENTS

EP 1054477 A 11/2000

* cited by examiner

*Primary Examiner* — Thanh-Tam T Le

(74) *Attorney, Agent, or Firm* — DeLio & Peterson, LLC; Robert Curcio

(57) ABSTRACT

The invention relates to a coaxial plug for connecting to a high-frequency transmission line. The housing of the coaxial plug has two slits arranged opposite each other, extending from the plug-side end in the axial direction, and both arranged and designed to form an axial abutment for receiving a BNC pin. A latching fork is arranged on the housing with two latching prongs tangentially overlapping an axial slit of the housing between the abutment and the plug-side end. Each BNC pin is held between a latching prong and an abutment of the axial slit, creating a locked connection between the coaxial plug and the BNC coaxial socket. The latching fork is pivotably arranged between a locking position in which the latching prongs tangentially overlap the axial slits, and a clearing position in which the latching prongs clear the axial slits over the entire length thereof.

15 Claims, 2 Drawing Sheets

COAXIAL PLUG FOR CONNECTING TO A BNC COAXIAL SOCKET

CROSS REFERENCED TO RELATED APPLICATION

This application is a National Phase filing under 35 U.S.C. §371 of PCT/EP/2007/010623 which was filed Dec. 6, 2007, and claims priority to German Application No. DE 20 2006 019 203.4 filed Dec. 20, 2006.

BACKGROUND OF THE INVENTION

1. Field of the Invention

The present invention relates to a coaxial plug having a housing, a plug-side end for connection to a BNC coaxial socket which has two BNC pins of a bayonet fitting, and having a cable-side end for connection to an RF transmission line.

2. Description of Related Art

By way of example, in order to connect a probe head to an instrument such as an oscilloscope, it is known for BNC coaxial sockets (BNC=Bayonet Naval Connector) to be arranged on the instrument, onto each of which coaxial sockets a corresponding BNC coaxial plug on the probe head can be plugged. However, additional electrical connecting lines are frequently required between the probe head and the instrument in order, for example, to transmit further signals and a supply voltage for the probe head. Since it is an intrinsic form of the BNC plug connection with a bayonet fitting that the BNC coaxial plug can rotate freely relative to the BNC coaxial socket, these additional connecting lines cannot initially be produced by means of the BNC plug connection. In order to circumvent this problem and to produce additional connecting lines between a probe head and instrument for example via contact pins which are arranged on a BNC coaxial socket and BNC coaxial plug, it is already known for an interlock to be provided between a housing of the instrument and a housing of the BNC coaxial plug of the probe head. The BNC coaxial plug can now be plugged onto the BNC coaxial socket only when it is specifically oriented relative to the latter, such that the correct contact pins on the BNC coaxial plug and BNC coaxial socket make contact with one another in a functionally reliable manner. However, this is complex and is dependent on the housing forms of the instrument and probe head having to be individually matched to one another. In other words, probe heads from different manufacturers are not compatible with all instruments from different manufacturers.

SUMMARY OF THE INVENTION

The invention is based on the object of refining a coaxial plug of the above-mentioned type such that a plug connection which cannot be twisted can be produced to a BNC coaxial socket and with a predetermined orientation relative to this BNC coaxial socket, irrespective of the form of the housing of the coaxial plug.

According to the invention, this object is achieved by a coaxial plug of the above-mentioned type having the characterizing features in claim 1. Advantageous refinements of the invention are described in the further claims.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
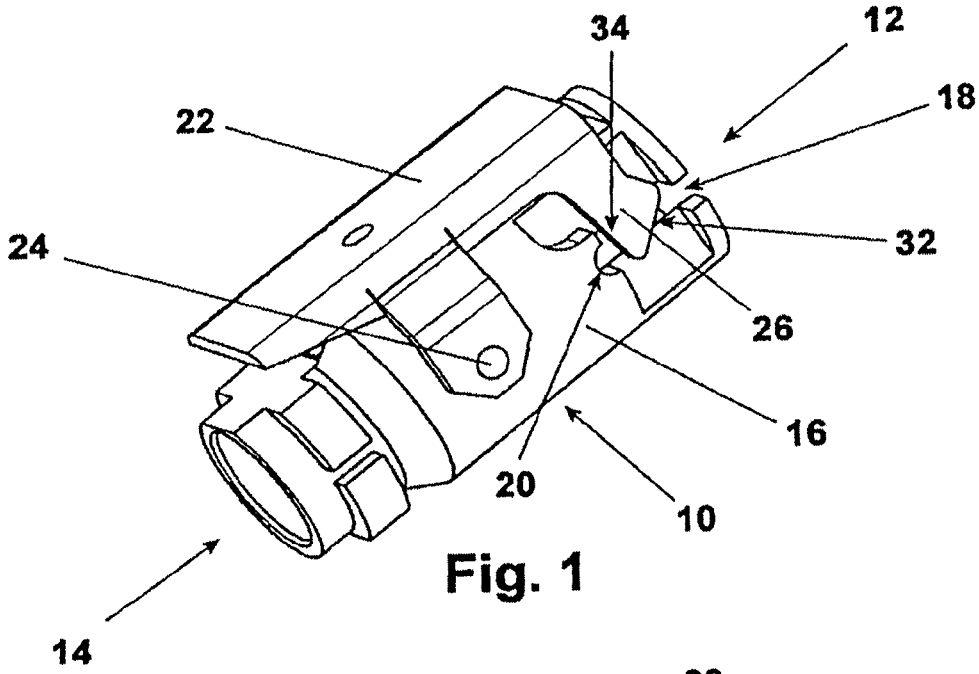
FIG. 1 shows a perspective view of one preferred embodiment of a coaxial plug according to the invention.

In describing the preferred embodiment of the present invention, reference will be made herein to FIGS. 1-4 of the drawings in which like numerals refer to like features of the invention.

In the case of a coaxial plug of the above-mentioned type, the invention provides that the housing of the coaxial plug has two slots which are arranged opposite, run in the axial direction starting from the plug-side end of the coaxial plug and are each arranged with and designed to hold a BNC pin such that they each form an axial stop for a BNC pin, with a latching fork being arranged on the housing of the coaxial plug and having two latching tines, with each latching tine engaging tangentially over an axial slot in the housing of the coaxial plug, between the stop and the plug-side end of the coaxial plug, such that, when a coaxial plug is plugged onto the BNC coaxial socket, one BNC pin is in each case held firmly between a latching tine and a stop of the axial slot, and a locked connection is produced between the coaxial plug and the BNC coaxial socket, with the latching fork being arranged such that it can pivot on the housing of the coaxial plug and having the capability to pivot between a locking position, in which the latching tines tangentially cover the axial slots, and a release position in which the latching tines release the axial slots over their entire length, such that the BNC pins can be inserted into the axial slots in the axial direction and can be pulled out of them in the axial direction.

This has the advantage that a coaxial plug which does not comply with the BNC Standard per se with regard to a rotating sleeve for a bayonet fitting can be connected in a functionally reliable manner to a BNC socket, with the axial slots at the same time ensuring a predetermined orientation between the coaxial plug and the BNC coaxial socket, as well as security against twisting of the coaxial plug relative to the BNC coaxial socket. Interacting with the BNC pins, the axial slots form a guide for the coaxial plug when it is pushed axially onto the BNC socket and, with the stop, limit the axial insertion depth. In addition, the latching fork is provided for locking, such that, instead of a rotary movement in order to lock a bayonet fitting, the latching fork just has to be pivoted into the locking position in order to produce a firmly locked connection between the coaxial plug and the BNC socket.

Automatic latching of the coaxial plug on the BNC coaxial socket is achieved by means of the latching fork by the latching fork having an elastic spring force applied to it in the direction of the locking position. This results in the coaxial plug being connected with a latched connection to the BNC coaxial socket simply by manually pushing the coaxial plug onto the BNC coaxial socket, with the locking on the latching fork latching on the BNC pins without any additional manual operations.

In one preferred embodiment, the axial slots are designed such that the BNC pins overhang the housing radially on the outside.

Since each latching tine has a first inclined surface on a side facing the plug-side end of the coaxial plug such that, when the latching fork is in the locking position, the tangential coverage of the axial slot by the latching tine increases, when seen in the direction from the plug-side end of the coaxial plug to the cable-side end of the coaxial plug, the latching fork is automatically pivoted to the release position by the BNC pins while the coaxial plug is being plugged onto the BNC socket.

An additional contact force for a coaxial plug which is locked to the BNC coaxial socket and draws the BNC coaxial socket axially into the coaxial plug, or vice versa, is achieved in that each latching tine has a second inclined surface on a side facing the cable-side end of the coaxial plug such that, when the latching fork is in the locking position, the tangential coverage of the axial slot by the latching tine decreases, when seen in the direction from the plug-side end of the coaxial plug to the cable-side end of the coaxial plug.

Figure 2:
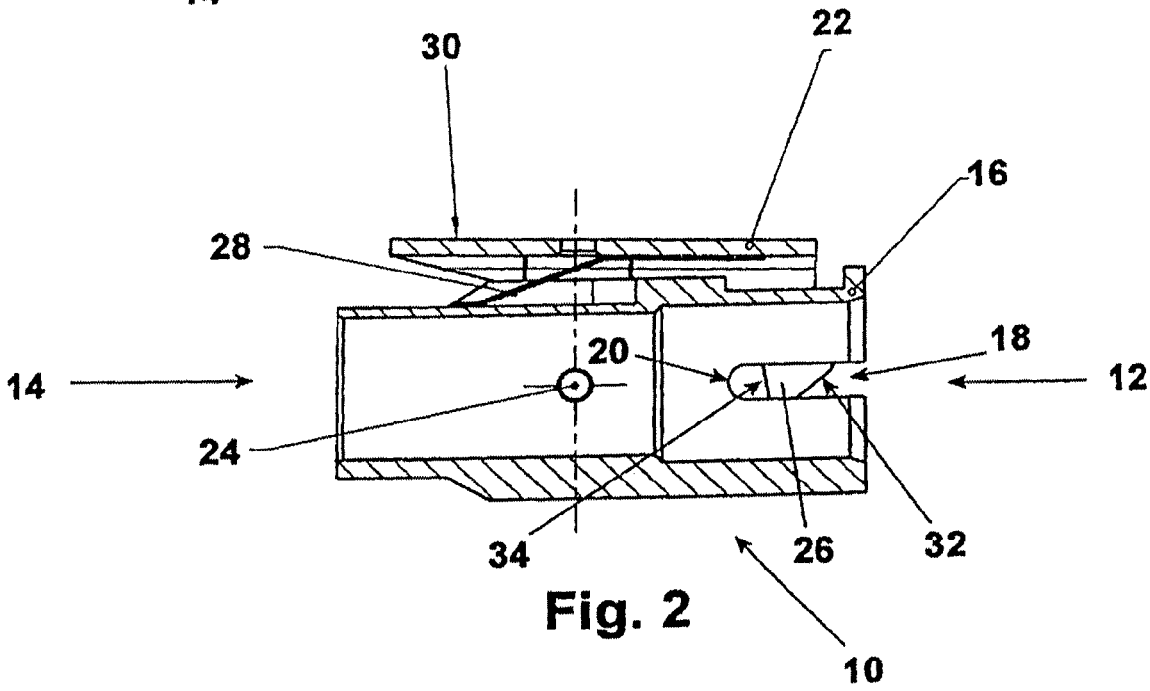
FIG. 2 shows a section view of the coaxial plug shown in FIG. 1.

The preferred embodiment of a coaxial plug 10 according to the invention as illustrated in FIGS. 1 and 2 with a plug-side end 12 and a cable-side end 14 comprises a housing 16 in which two opposite, axial slots 18 are formed, which extend in the axial direction starting from the plug-side end 12. Each axial slot 18 ends with a stop 20. The cable-side end is used to connect the coaxial plug 10 to an RF transmission line, for example a coaxial cable. A latching fork 22 is arranged on the housing 16 such that it can pivot about a pivoting axis 24. The latching fork 22 comprises two latching tines 26, each of which covers an axial slot 18 tangentially between the plug-side end 12 and the stop 20 when the latching fork 22 is located in the locking position as illustrated in FIGS. 1 and 2. A leaf spring 28 applies an elastic spring force to the latching fork 22 such that the latching fork 22 is pressed into the locking position.

When pressure is exerted on the latching fork 22 at the point indicated by the arrow 30, the latching fork 22 is pivoted about the pivoting axis 24 to a release position (not illustrated), in which the latching tines 26 no longer cover the axial slots 18, as a result of which the axial slots 18 can be passed through freely in the axial direction.

Each latching tine 26 has a first inclined surface 32 on a side facing the plug-side end 12 of the coaxial plug 10 such that, when the latching fork 22 is in the locking position, the tangential coverage of the axial slot 18 by the latching tine 26 increases, when seen in the direction from the plug-side end 12 of the coaxial plug 10 to the cable-side end 14 of the coaxial plug 10, as can be seen in particular in FIG. 2. Each latching tine 26 has a second inclined surface 34 on a side facing the cable-side end 14 of the coaxial plug 10 such that, when the latching fork 22 is in the locking position, the tangential coverage of the axial slot 18 by the latching tine 26 decreases, when seen in the direction from the plug-side end 12 of the coaxial plug 10 to the cable-side end 14 of the coaxial plug 10, as can be seen in particular in FIG. 2.

Figure 3:
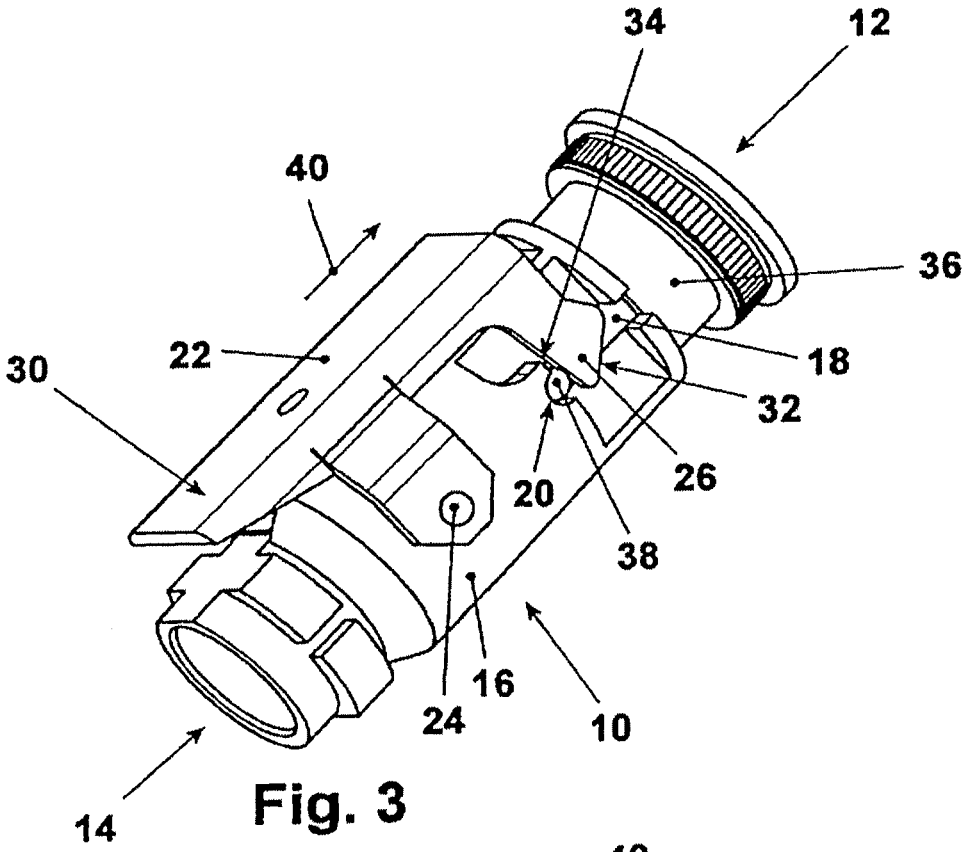
FIG. 3 shows a perspective view of the coaxial plug shown in FIG. 1, in a state in which it is plugged onto a BNC coaxial socket.
Figure 4:
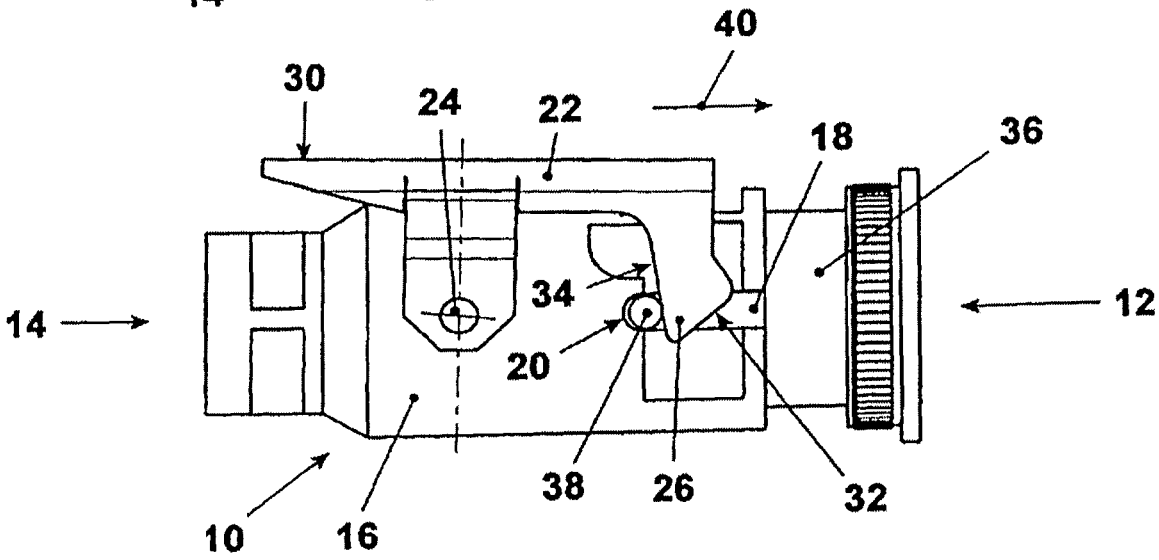
FIG. 4 shows a side view.

FIGS. 3 and 4 illustrate the coaxial plug 10 according to the invention in the state in which it is plugged onto a BNC coaxial socket 36. This BNC coaxial socket 36 comprises two BNC pins 38, which were originally used for a known bayonet fitting of a correspondingly designed BNC plug with a bayonet rotating sleeve, as is normal practice with BNC plug connectors. When the coaxial plug 10 according to the invention is pushed onto the BNC coaxial socket 36 in the axial direction or the insertion direction 40, the axial slots 18 engage over the BNC pins 38, such that the coaxial plug 10 according to the invention can be plugged onto the BNC coaxial socket 36 in only one specific position relative to the BNC coaxial socket 36. Interacting with the axial slots 18, the BNC pins 38 additionally form a guide and twisting protection. When the coaxial plug 10 according to the invention is plugged axially onto the BNC coaxial socket 36, the BNC pins 38, which overhang the housing 16 in the radial direction, first of all slide along the first inclined surfaces 32 of the latching tines 26 and in this way press or pivoting the latching fork 22 against the elastic spring force of the leaf spring 28 out of the locking position into the release position. The axial slots 18 are therefore released, and the BNC pins 38 can be pushed further in the axial direction into and along the axial slots 18, as far as the respective stops 20. During the process, the BNC pins 38 leave the area of the first inclined surfaces 32, and the latching fork 22 pivots back to the locking position, under the influence of the elastic spring force of the leaf spring 28. The BNC pins 38 are therefore locked between the stops 20 and the latching tines 26, and cannot once again be pulled out of the axial slots 18 in the direction of the arrow 40. The coaxial plug 10 and the BNC coaxial socket 36 are therefore firmly connected to one another. The second inclined surfaces 34 of the latching tines 26 press against the BNC pins 38 under the influence of the elastic spring force of the leaf spring 28, as a result of which these pins 38 are pressed against the stops 20 in the direction of the arrow 40, or in the opposite direction to the arrow 40. This produces a corresponding contact pressure in order to make an electrical contact between the coaxial plug 10 and the BNC coaxial socket 36.

Overall, the mechanical and electrical connection of the coaxial plug 10 to the BNC coaxial socket 36 is achieved by simply plugging the coaxial plug 10 onto the BNC coaxial socket 36 in the insertion direction 40 until the BNC pins 38 strike the stops 20. The locking connection between the coaxial plug 10 and the BNC coaxial socket 36 is in this case produced automatically by the latching fork 22. In order to release the coaxial plug 10 from the BNC coaxial socket 36, a pressure is exerted manually on the latching fork 22 as indicated by the arrow 30, as a result of which the latching fork 22 pivots about the pivoting axis 24 to the release position, against the elastic spring force of the leaf spring 28. The movement of the BNC pins 38 out of the axial slots 18 in the direction of the arrow 40 is therefore no longer blocked by the latching tines 26, as a result of which the coaxial plug 10 can be pulled off the BNC coaxial socket 36, in the opposite direction to the insertion direction 40.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A coaxial plug comprising:

a housing;

a plug-side end for connection to a BNC coaxial socket which has two BNC pins of a bayonet fitting; and a cable-side end for connection to an RF transmission line, in particular a coaxial cable, wherein said housing of the coaxial plug includes:

two slots which are arranged opposite, run in an axial direction starting from the plug-side end of the coaxial plug and are each arranged with and designed to hold a BNC pin such that said slots each form an axial stop for said BNC pin; and a latching fork being arranged on the housing of the coaxial plug including two latching tines, with each latching tine engaging tangentially over said axial slot in the housing of the coaxial plug, between the stop and the plug-side end of the coaxial plug, such that, when said coaxial plug is plugged onto the BNC coaxial socket, said BNC pin is in each case held firmly between said latching tine and said stop of the axial slot, and a locked connection is produced between the coaxial plug and the BNC coaxial socket, with the latching fork being arranged such that it can pivot on the housing of the coaxial plug and having the capability to pivot between a locking position, in which the latching tines tangentially cover the axial slots, and a release position in which the latching tines release the axial slots over their entire length, such that the BNC pins can be inserted into the axial slots in the axial direction and can be pulled out of them in the axial direction.

2. The coaxial plug of claim 1, including an elastic spring in mechanical communication with said latching fork, said latching fork being responsive to said elastic spring when said elastic spring applies a force in the direction of the locking position.

3. The coaxial plug of claim 1 including having the axial slots designed such that the BNC pins overhang the housing radially on the outside.

4. The coaxial plug of claim 1 wherein said each latching tine includes a first inclined surface on a side facing the plug-side end of the coaxial plug such that, when the latching fork is in the locking position, the tangential coverage of the axial slot by the latching tine increases, when seen in the direction from the plug-side end of the coaxial plug to the cable-side end of the coaxial plug.

5. The coaxial plug of claim 4, wherein said each latching tine includes a second inclined surface on a side facing the cable-side end of the coaxial plug such that, when the latching fork is in the locking position, the tangential coverage of the axial slot by the latching tine decreases, when seen in the direction from the plug-side end of the coaxial plug to the cable-side end of the coaxial plug.

6. The coaxial plug of claim 2 including having the axial slots designed such that the BNC pins overhang the housing radially on the outside.

7. The coaxial plug of claim 2 wherein said each latching tine includes a first inclined surface on a side facing the plug-side end of the coaxial plug such that, when the latching fork is in the locking position, the tangential coverage of the axial slot by the latching tine increases, when seen in the direction from the plug-side end of the coaxial plug to the cable-side end of the coaxial plug.

8. The coaxial plug of claim 3 wherein said each latching tine includes a first inclined surface on a side facing the plug-side end of the coaxial plug such that, when the latching fork is in the locking position, the tangential coverage of the axial slot by the latching tine increases, when seen in the direction from the plug-side end of the coaxial plug to the cable-side end of the coaxial plug.

9. The coaxial plug of claim 7, wherein said each latching tine includes a second inclined surface on a side facing the cable-side end of the coaxial plug such that, when the latching fork is in the locking position, the tangential coverage of the axial slot by the latching tine decreases, when seen in the direction from the plug-side end of the coaxial plug to the cable-side end of the coaxial plug.

10. The coaxial plug of claim 8, wherein said each latching tine includes a second inclined surface on a side facing the cable-side end of the coaxial plug such that, when the latching fork is in the locking position, the tangential coverage of the axial slot by the latching tine decreases, when seen in the direction from the plug-side end of the coaxial plug to the cable-side end of the coaxial plug.

11. A coaxial plug comprising:

a housing:

a plug-side end for connection to a BNC coaxial socket which has two BNC pins of a bayonet fitting; and a cable-side end for connection to an RF transmission line, in particular a coaxial cable, wherein said housing of the coaxial plug includes:

two slots which are arranged opposite, run in an axial direction starting from the plug-side end of the coaxial plug and are each arranged with and designed to hold a BNC pin such that said slots each form an axial stop for said BNC pin;

a latching fork being arranged on the housing of the coaxial plug including two latching tines, with each latching tine engaging tangentially over said axial slot in the housing of the coaxial plug, between the stop and the plug-side end of the coaxial plug, such that, when said coaxial plug is plugged onto the BNC coaxial socket, said BNC pin is in each case held firmly between said latching tine and said stop of the axial slot, and a locked connection is produced between the coaxial plug and the BNC coaxial socket, with the latching fork being arranged such that it can pivot on the housing of the coaxial plug and having the capability to pivot between a locking position, in which the latching tines tangentially cover the axial slots, and a release position in which the latching tines release the axial slots over their entire length, such that the BNC pins can be inserted into the axial slots in the axial direction and can be pulled out of them in the axial direction; and an elastic spring in mechanical communication with said latching fork, said latching fork being responsive to said elastic spring when said elastic spring applies a force in the direction of the locking position.

12. The coaxial plug of claim 11 including the axial slots designed such that the BNC pins overhang the housing radially on the outside.

13. A coaxial plug comprising:

a housing:

a plug-side end for connection to a BNC coaxial socket which has two BNC pins of a bayonet fitting; and a cable-side end for connection to an RF transmission line, in particular a coaxial cable, wherein said housing of the coaxial plug includes:

two slots which are arranged opposite, run in an axial direction starting from the plug-side end of the coaxial plug and are each arranged with and designed to hold a BNC pin such that said slots each form an axial stop for said BNC pin, the axial slots designed such that the BNC pins overhang the housing radially on the outside;

a latching fork being arranged on the housing of the coaxial plug including two latching tines, with each latching tine engaging tangentially over said axial slot in the housing of the coaxial plug, between the stop and the plug-side end of the coaxial plug, such that, when said coaxial plug is plugged onto the BNC coaxial socket, said BNC pin is in each case held firmly between said latching tine and said stop of the axial slot, and a locked connection is produced between the coaxial plug and the BNC coaxial socket, with the latching fork being arranged such that it can pivot on the housing of the coaxial plug and having the capability to pivot between a locking position, in which the latching tines tangentially cover the axial slots, and a release position in which the latching tines release the axial slots over their entire length, such that the BNC pins can be inserted into the axial slots in the axial direction and can be pulled out of them in the axial direction; and an elastic spring in mechanical communication with said latching fork, said latching fork being responsive to said elastic spring when said elastic spring applies a force in the direction of the locking position.

14. A coaxial plug comprising:

a housing:

a plug-side end for connection to a BNC coaxial socket which has two BNC pins of a bayonet fitting; and a cable-side end for connection to an RF transmission line, in particular a coaxial cable, wherein said housing of the coaxial plug includes:

two slots which are arranged opposite, run in an axial direction starting from the plug-side end of the coaxial plug and are each arranged with and designed to hold a BNC pin such that said slots each form an axial stop for said BNC pin;

a latching fork being arranged on the housing of the coaxial plug including two latching tines, with each latching tine engaging tangentially over said axial slot in the housing of the coaxial plug, between the stop and the plug-side end of the coaxial plug, such that, when said coaxial plug is plugged onto the BNC coaxial socket, said BNC pin is in each case held firmly between said latching tine and said stop of the axial slot, and a locked connection is produced between the coaxial plug and the BNC coaxial socket, with the latching fork being arranged such that it can pivot on the housing of the coaxial plug and having the capability to pivot between a locking position, in which the latching tines tangentially cover the axial slots, and a release position in which the latching tines release the axial slots over their entire length, such that the BNC pins can be inserted into the axial slots in the axial direction and can be pulled out of them in the axial direction, and wherein said each latching tine includes a first inclined surface on a side facing the plug-side end of the coaxial plug such that, when the latching fork is in the locking position, the tangential coverage of the axial slot by the latching tine increases, when seen in the direction from the plug-side end of the coaxial plug to the cable-side end of the coaxial plug; and an elastic spring in mechanical communication with said latching fork, said latching fork being responsive to said elastic spring when said elastic spring applies a force in the direction of the locking position.

15. The coaxial plug of claim 14, wherein said each latching tine includes a second inclined surface on a side facing the cable-side end of the coaxial plug such that, when the latching fork is in the locking position, the tangential coverage of the axial slot by the latching tine decreases, when seen in the direction from the plug-side end of the coaxial plug to the cable-side end of the coaxial plug.

* * * * *